US005707307A

United States Patent [19]

Robben et al.

[11] Patent Number: 5,707,307

[45] Date of Patent: Jan. 13, 1998

[54] BUSINESS/PLEASURE DART

[76] Inventors: Carlos Robben; Sandra Hudson, both of 1023 A 6th Ave., Leavenworth, Kans. 66048

[21] Appl. No.: 670,584

[22] Filed: Jun. 26, 1996

[51] Int. Cl.[6] ..... A63B 65/02

[52] U.S. Cl. ..... 473/585; 401/31; 401/195

[58] Field of Search ..... 473/578, 582, 473/585, 581; 401/31, 195, 52

[56] References Cited

U.S. PATENT DOCUMENTS

| | | | |
|---|---|---|---|
| 14,306 | 2/1856 | Crosws | 401/31 X |
| D. 280,110 | 8/1985 | Brooks | 401/195 X |
| 2,604,693 | 7/1952 | Schierstead | 401/31 X |
| 3,266,806 | 8/1966 | Warren et al. | 473/581 |
| 3,282,253 | 11/1966 | Ryan et al. | 401/195 X |
| 3,750,729 | 8/1973 | Lemieux | 401/31 X |
| 3,865,496 | 2/1975 | Robbins | 401/31 X |
| 4,109,915 | 8/1978 | Bottelsen | 273/106.5 |
| 4,635,309 | 1/1987 | Larsen | 401/52 X |
| 4,778,302 | 10/1988 | Martinez | 401/195 |
| 4,840,383 | 6/1989 | Lombardo | 273/420 |
| 5,248,151 | 9/1993 | Pickup | 273/420 |
| 5,375,850 | 12/1994 | Pickett | 273/420 |

FOREIGN PATENT DOCUMENTS

| | | | |
|---|---|---|---|
| 967144 | 3/1950 | France | 401/195 |
| 989803 | 5/1951 | France | 401/31 |
| 3030750 | 3/1982 | Germany | 401/195 |
| 2224452 | 5/1990 | United Kingdom | 473/219 |

OTHER PUBLICATIONS

United States Purchasing Exchange catalog, p. 13, 5-in-1 Wonder Pen-Tool, Sep. 1978.

*Primary Examiner*—Paul E. Shapiro

*Attorney, Agent, or Firm*—Patent & Trademark Services; Thomas Zack; Joseph H. McGlynn

[57] ABSTRACT

A combined dart and writing implement, such as a ball point pen. Each are contained within the same housing and movable from a retracted to an extended position. When extended, their tip portion extends through an orifice in the housing. Both the dart and writing implement have springs to retract them and each is moved by pushing a finger operated button.

5 Claims, 1 Drawing Sheet

BUSINESS/PLEASURE DART

BACKGROUND OF THE INVENTION

The present invention relates to a combined ball-point pen and sporting dart. Both the pen and dart are each are individually retractable into the same housing and releasable to protrude therefrom by actuating one of two buttons.

DESCRIPTION OF THE PRIOR ART

In the prior art various types of separate darts and separate pens are known. Some darts may break away from the point of impact (U.S. Pat. No. 4,109,915 to Bottelsen). Others (U.S. Pat. No. 4,840,383 to Lombardo)disclose darts that may be illuminated with a battery and a light producing element. Still others (U.S. Pat. No. 5,248,151 to Pickup) may have a point contraction system when the dart point impacts wire or staples and the like. With some references the dart's nose piece and tail piece (U.S. Pat. No. 5,375,850 to Pickett) are replaceable. None, however, disclose the combination of a dart and pen as disclosed herein.

SUMMARY OF THE INVENTION

The present invention consists of a combined dart and ball point pen housed in a common housing with a tip orifice. Both the dart and ball point pen can be reciprocated in the same direction within the housing. And each may be extended to protrude from the orifice by pushing one of two housing buttons. A snap lock keeps the protruded portion extended until it is disengaged.

It is an object of the present invention to provide an improved dart which can also be used as a pen.

It is a further object of the present invention to provide such an invention all within a common housing wherein either the dart or pen may protrude from the housing.

These and other objects and advantages of the present invention will be fully apparent from the following description, when taken in connection with the annexed drawings.

DESCRIPTION OF THE PREFERRED EMBODIMENT

Figure 1:
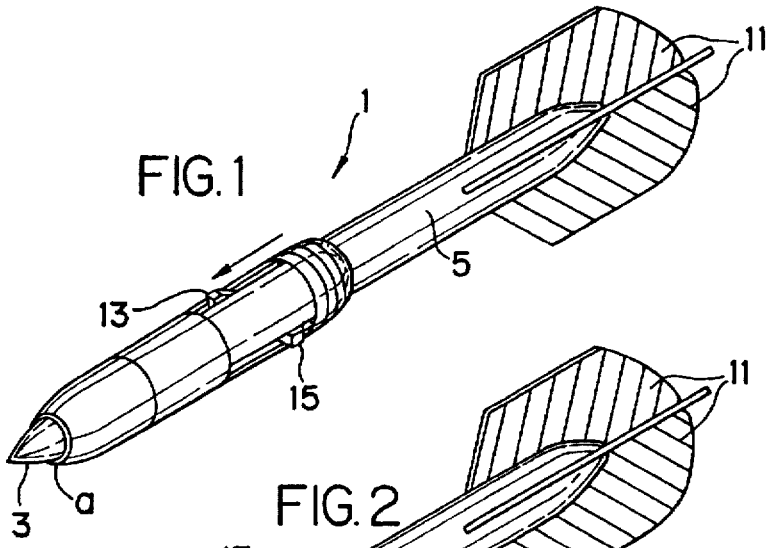
FIG. 1 is a perspective view of the preferred embodiment of the present invention showing it with its pen tip extended.

Referring now to the drawings in greater detail, FIG. 1 shows the combined dart and pen 1 with its ball point pen tip 3 extended from the common elongated housing 5. Typically the ball point pen tip is operative connected to an ink supply cartridge. The dart's pointed tip is within the housing and is not shown in this figure. Located at the end opposite the common orifice 9 from which the tip protrudes, are three equally spaced identical tail air foil plastic fins 11 similar to those found in many darts. Two separate thrust cam devices 13 and 15 can slide in body channels to reciprocate lengthwise in the direction of the arrows (or in the opposite direction) and function as push buttons to move either the pen or dart. As shown, the button 13 which moves the pen is in its forward most locked position and the button 15 used to move the dart is in its most rearward position to retract the dart tip.

Figure 2:
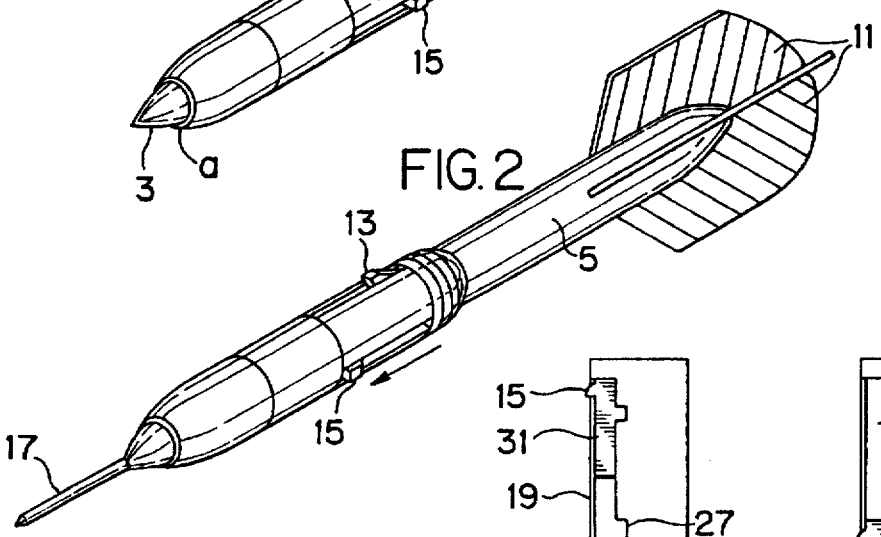
FIG. 2 is a perspective view of the same invention showing its dart tip extended.

FIG. 2 depicts the dart tip 17 extended from the common housing 5. In this state, the reciprocating buttons are now reversed in position from where they were in FIG. 1. Button 13 is retracted to its rearward position and button 15 which controls the movement of the dart is locked in its forward position to allow the dart to protrude from common orifice 9.

Figure 3:
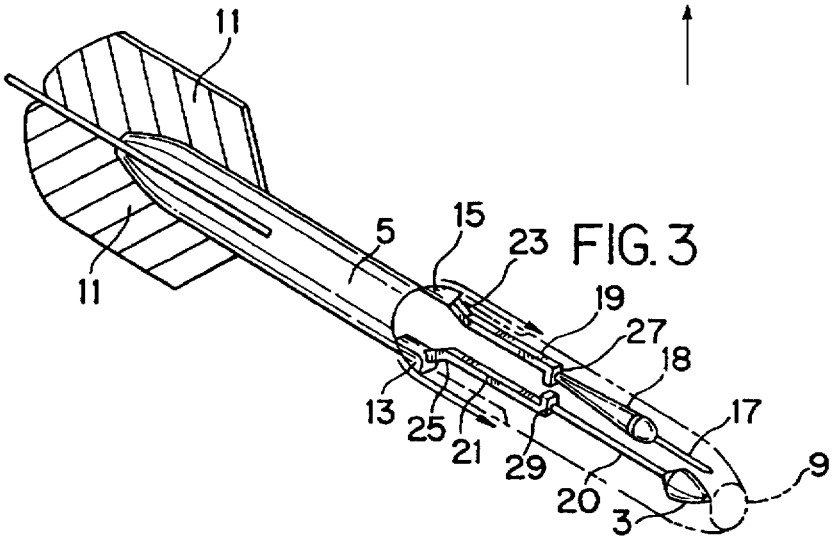
FIG. 3 shows part of the internal working mechanism in a cut away section.

FIG. 3 is a perspective partial cut away sectional view illustrating the internal disposition of the movable dart and pen tips. Each tip is connected to its respective push button by a solid elongated generally straight section member with two offset connectors. Both tips with their respective section and connectors can move forward in the direction of the arrows or rearward in the opposite direction. For the dart tip 17 is connected to a dart body section 18 which connect it to elongated straight section 19 which in turn is joined to the dart button 15. The pen tip 3 is joined to its ink cartridge 20 and section 21 to the button 13. At the point where their straight sections join to the buttons are angled offset connecting segments 23 and 25 portions for the dart and pen, respectively. At the other end of the straight sections are right angled offsets 27 and 29 which connect, respectively, the dart and pen tips to their straight sections.

Figure 4A:
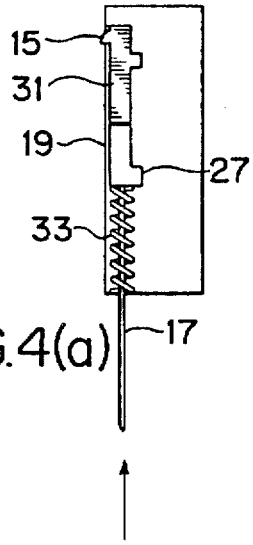
FIGS. 4(*a*) and 4(*b*) schematically illustrate the locking mechanisms used to control the movement of the pen and dart.
Figure 4B:
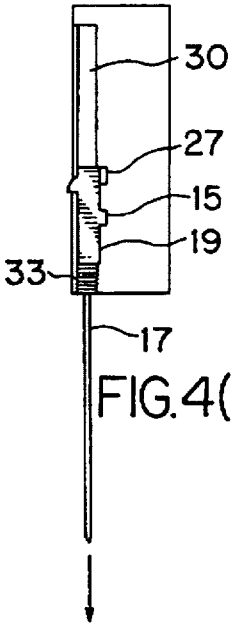

FIG. 4 a schematic view and is used to provide additional information on the movement and locking mechanism for the pen and dart tips within the common housing. Each tip is moved the same way and has essentially the same type of thrust cam device. The buttons are moved by finger force within body channels (one shown as 30) from a forward to rearward position and vice versa. When this happens their respective attach tips are moved between a protruded (forward) position to a retracted (rearward) position or the other way around. FIG. 4(*a*) shows button 15 and its dart tip 17 retracted from the housing's orifice with its snap lock 27 (the right angled front connector offset 27) in an unlocked position. FIG. 4 (*b*) shows the same button/tip moved forward by a user's finger force such that its snap lock engages an internal recess within the body of the housing. When this happens a spring 33 larger in diameter than the orifice which encircles the tip is compressed and the button moves to its forward position. By depressing the button the snap lock disengages from its recess and is then forced rearward by the compressed spring to its rearward retracted position. Both tips move the same way.

The much of this invention may be manufactured in several ways. For the common body part the most cost effective method would be injection molding of plastic. If a metal case is required, die casting is the second most cost effective manufacturing method. With the injection molding process softened plastic material is forced under very high pressure into a relatively cool metal, like aluminum and steel, cavity mold having two or more component cavities. This mold is shaped like the desired products and high pressure hydraulics are used to keep the mold components together during the injection phase. Once the plastic cools and hardens, the hydraulic pressure is released and the mold components separated and the formed solid removed. This process can be automated and can produce extremely detailed parts at a very cost effective price.

Die casting could also be used to manufacture this invention's common body housing. With this process molten metal such as brass, aluminum or steel is injected into hardened hollow dies. The hollow dies consist of two or more parts forming a negative version of the part to be cast. After the metal is injected and allowed to cool, a completed part having great detail is removed.

Other components such as the ball point ink cartridge and the springs, dart tips are off the shelf parts and can be acquired from commercial sources.

Although the Business/Pleasure Dart and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A combined dart and writing implement comprising:

a common housing with depending air fins having an orifice at one end;

a dart tip adapted to fit within said housing and movable from a retract within the body to a position wherein it extends from the housing's orifice; and a writing implement tip also adapted to fit within said housing and movable from a retract within the body to a position wherein it extends from the housing's orifice.

2. The invention as claimed in claim 1, wherein both said dart and writing implement tips have attached push buttons and are movable in a reciprocating manner in the same direction within said common housing.

3. The invention as claimed in claim 2, wherein each of said buttons rides within a separate channel in the common housing.

4. The invention as claimed in claim 3, wherein each tip is operatively associated with a compression spring having a diameter greater than that of the orifice.

5. The invention as claimed in claim 4, wherein there are means to hold a protruded tip in its orifice extended position.

* * * * *